US006986307B2

(12) United States Patent
Bernhard et al.

(10) Patent No.: US 6,986,307 B2
(45) Date of Patent: Jan. 17, 2006

(54) BRIDGE-TYPE IGNITER IGNITION ELEMENT

(75) Inventors: Winfried Bernhard, Gerlingen (DE); Lutz Mueller, Aichtal (DE); Ulrich Kunz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/653,837

(22) Filed: Sep. 2, 2003

(65) Prior Publication Data

US 2004/0134371 A1 Jul. 15, 2004

(30) Foreign Application Priority Data

Aug. 30, 2002 (DE) ..... 102 40 053

(51) Int. Cl.
*F42B 3/13* (2006.01)

(52) U.S. Cl. ..... 102/202.7; 102/202.5; 280/741

(58) Field of Classification Search ..... 102/202.7, 102/201, 202.1, 202.5, 202.9; 60/532, 741; 280/741

See application file for complete search history.

(56) References Cited

U.S. PATENT DOCUMENTS 4,301,212 A * 11/1981 Cohnen et al. ..... 428/412
4,700,629 A * 10/1987 Benson et al. ..... 102/201
4,843,964 A * 7/1989 Bickes et al. ..... 102/202.5
5,029,529 A * 7/1991 Mandigo et al. ..... 102/202.9
5,088,413 A * 2/1992 Huber et al. ..... 102/202.5
5,285,727 A * 2/1994 Reams et al. ..... 102/202.5
5,370,053 A * 12/1994 Williams et al. ..... 102/202.5
5,370,054 A * 12/1994 Reams et al. ..... 102/202.5
5,385,097 A * 1/1995 Hruska et al. ..... 102/202.5
5,648,634 A * 7/1997 Avory et al. ..... 102/202.1
5,847,309 A * 12/1998 Baginski ..... 102/202.2
6,173,650 B1 * 1/2001 Garvick et al. ..... 102/202.5
6,178,888 B1 * 1/2001 Neyer et al. ..... 102/202.7
6,302,024 B1 * 10/2001 Swart et al. ..... 102/202.5
6,327,978 B1 * 12/2001 Turano et al. ..... 102/202.7
6,470,802 B1 * 10/2002 Neyer et al. ..... 102/202.5
6,539,875 B2 * 4/2003 Duvacquier et al. ..... 102/530

FOREIGN PATENT DOCUMENTS

DE 37 17 149 11/1987

* cited by examiner

*Primary Examiner*—Teri Pham Luu
*Assistant Examiner*—Bret Hayes
(74) *Attorney, Agent, or Firm*—Kenyon & Kenyon

(57) ABSTRACT

A bridge-type ignition element for initiating the ignition of pyrotechnical materials lying above it by heating when an electric current is passed through it. The bridge-type element is essentially made up of a resistance layer applied to a substrate, a reactive layer, applied on top of that, made of especially an oxidizable metal and a polymeric cover layer situated on top of that, whose material is selected in such a way that it is able to react exothermally at an elevated temperature with the oxidizable material of the reactive layer. The polymeric cover layer makes possible not only a lower energy requirement but also achieves corrosion protection from the surroundings and from the pyrotechnical material.

6 Claims, 1 Drawing Sheet

BRIDGE-TYPE IGNITER IGNITION ELEMENT

FIELD OF THE INVENTION

The present invention relates to a bridge-type igniter ignition element for initiating the ignition of pyrotechnical material lying above it, by heating when an electric current is passed through, having connecting elements at the end for electrical lines and a resistor element between these, connecting elements and resistor elements being mounted on a substrate.

BACKGROUND INFORMATION

Ignition elements are known per se in diverse construction forms, and are used for initiating the pyrotechnical material safely and at a point in time as defined as possible, or rather to initiate its ignition. The energy for the initiation should be as little as possible.

With respect to the pyrotechnical materials, not only are bursting charges involved, such as for blasting construction works or in mining, but also materials for triggering so-called irreversibly triggerable safety elements in motor vehicles, such as air bags, seat belt temsioning devices and the like. In particular in the case of the latter application, the safe and timewise accurate initiation at an energy expenditure that is as low as possible is of particular importance, ignition faults being safely avoided, in addition.

It is also known that one may position protective circuits and control circuits on the same substrate (cf German Patent No. 37 17 149).

In one typical design, on one substrate an adhesion layer of titanium, for example, is first applied onto which a resistance material such as palladium is applied, as is done, for instance, for integrated circuits. On this resistance material, in turn, a reactive layer made of Zr or Hf, for example, is applied, on which there is provided, in turn, a layer of a reaction partner, such as CuO. This assemblage is generally elongated in a top view and has connecting elements for electrical conductors at the ends. For this purpose, a contact layer such as gold may be applied to the resistance material. These end devices have a comparatively large area in a top view, so that overall there comes about a bridge-like appearance. If an external mechanical or electronic switch is closed, which may also be present on the same substrate, current is able to flow through the bridge section, between the two connecting elements. The resistance layer and the reactive layer present on the resistance layer are thereby heated. The heated reactive layer, in turn, reacts exothermally with the reaction partner, whereby the pyrotechnical material present on this assemblage is initiated. The exothermic reaction achieved in the case of the exemplary construction, $$Zr+2CuO \rightarrow ZrO2+Cu$$

results in a reaction enthalpy $\Delta H=-772$ kJ/mol (corresponding to:

$Zr+O_2$: $\Delta H=-1089$ kJ/mol, $Cu+0.5O_2 \rightarrow CuO$: $\Delta H=-157$ kJ/mol;

$Zr+2CuO \rightarrow Cu+ZrO_2$: $\Delta H=-108-(2\times-157)=-772$ kJ/mol).

Ignition elements of fundamentally the same construction and way of functioning, depending on the kind of materials used, are able also to do, if necessary, without an adhesive and/or a reaction partner; if necessary, the bridge section alone may be formed by a reactive layer.

By contrast, it is the object of the present invention to improve the known ignition element design so that ignition is possible at even low energy input.

SUMMARY OF THE INVENTION

According to the present invention, an object is attained by covering the reaction layer from the surroundings and the pyrotechnical material, using a polymer cover layer.

The bridge-type igniter ignition element is especially suitable for triggering irreversible elements of restraint in motor vehicles, such as air bags and seat belt tensioning devices.

The polymer cover layer according to the present invention protects, on the one hand, the reactive layer important to the functioning, from corrosion by environmental oxygen or dampness in the air, and also from corrosion by the pyrotechnical material ("ignition powder"). What is more, the polymer cover layer reacts exothermally at increased temperature, so that all-in-all a low energy input is required for the initiation, desired at the end, of the pyrotechnical material.

DETAILED DESCRIPTION

Figure 1:
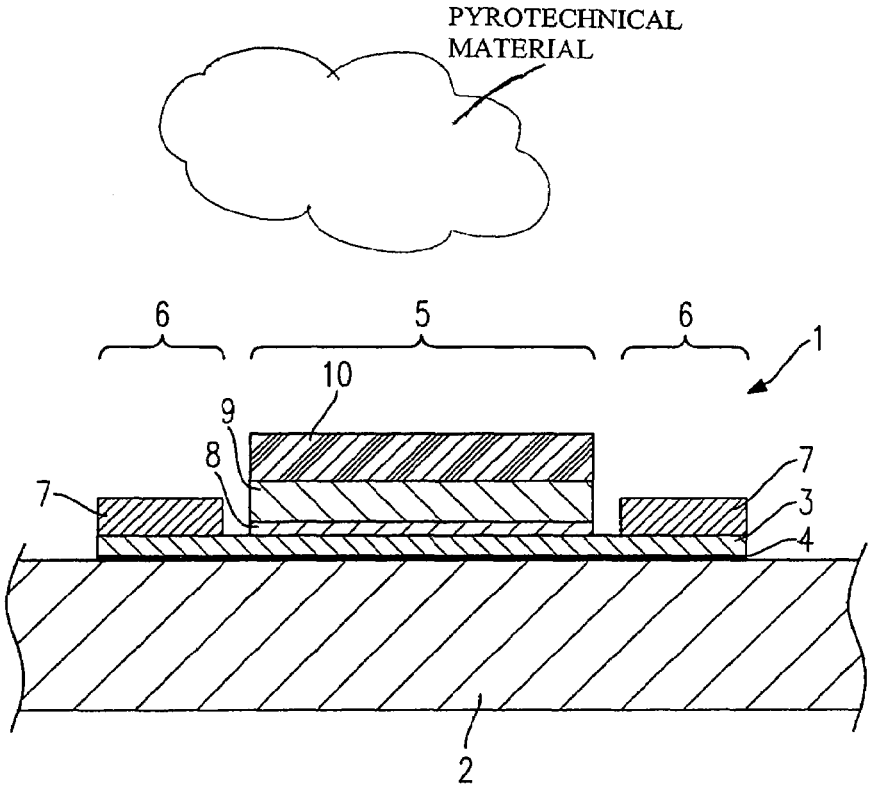
FIG. 1 corresponding to Section I:I in FIG. 2 shows the fundamental construction of a bridge-type igniter ignition element according to the present invention.
Figure 2:
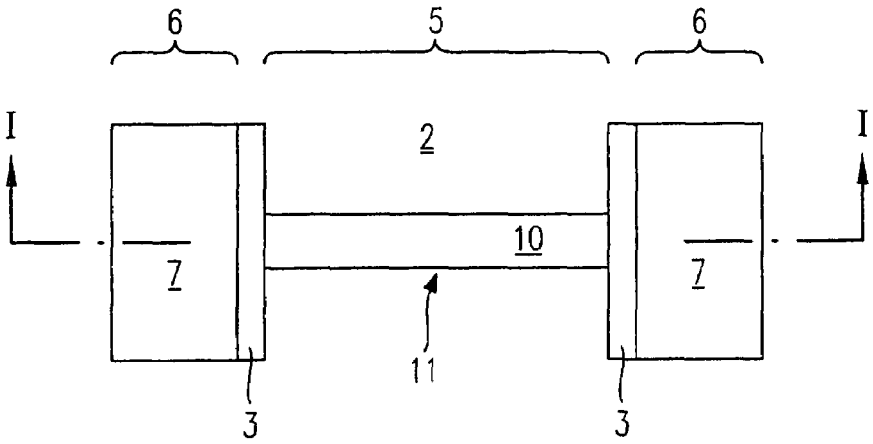
FIG. 2 shows in a top view the bridge-type igniter ignition element as in FIG. 1.

Ignition element 1 according to the present invention is formed on a substrate 2 in the exemplary embodiment. A resistance layer 3 is applied to substrate 2 directly or via an adhesive layer 4. Resistance layer 3 and possibly adhesive layer 4 on substrate 2 have, as may be seen in the top view as in FIG. 2, a centrical, narrow bridge section 5 and two planar connecting sections 6 at each end. Contacting with external electrical circuits, especially for ignition, takes place via connecting sections 6, and is not shown. Therefore, in the exemplary embodiment, a contact section 7, made of such as gold or another material that is very highly conductive and is easily connected to electrically conductive elements, is applied to connecting sections 6 of resistance layer 3. In the centrical, small bridge section 5, an insulating layer 8 is applied onto resistance layer 3 in the exemplary embodiment. On insulating layer 8, which also does not necessarily have to be there, a reaction or reactive layer 9 is applied, on which, in turn, a polymer cover layer 10 is applied as a protective layer and as a reaction partner. In the installed state, this polymer cover layer 10 of a resistor element 11 thus formed overall is in contact with the pyrotechnical material to be initiated (not shown). Polymer cover layer 10 may also cover entire substrate 2, i.e. it may also not be structured.

Any material is suitable for the substrate which itself has no chemical reaction with the material of resistance layer 3 or possibly adhesive layer 4, and particularly suitable are materials that are used in integrated circuits (IC), (silicon, if necessary having an $SiO_2$ insulating layer), ceramics and plastics too. Oxidizable metals are suitable as reactive layer 9, such as, particularly, Zr, Al, Hf, Ta, Nb, Y, Si, Ce and all the lanthanides. In order to attain large surfaces, porous layers are especially suitable as reactive layer 9, since thereby the oxidizing agent gains easier access during the exothermic reaction.

All polymeric materials, which are able to react with the oxidizable metals of reactive layer 9 at an elevated temperature, are suitable as materials for polymeric cover layer 10. Fluorine-containing polymers, chlorine-containing polymers and oxygen-containing polymers are advantageous. Typical representatives of fluorine-containing polymers are, for example, protective lacquer FC722 of the firm of 3M, soluble teflon AF of the firm of DuPont, solutions of a polymer of perfluorooctyl acrylate, such as AC8 of the firm of Atofina or PTFE layers which may be deposited using the CVD technique. Typical chlorine-containing polymers are, for example, chlorinated rubber lacquers, or PVC. Typical oxygen-containing polymers are, for instance, nitrocellulose lacquers, collodium lacquers or gun cotton lacquer.

As the material for adhesive layer 4 which is to be provided if necessary, Ti alloys and Ni/Cr alloys are particularly suitable. The usually known palladium may be used as the material for resistance layer 3.

All current techniques for applying various layers to the substrate are suitable for each respective substrate 2.

In particular, resistance layer 3 and, if necessary, adhesive layer 4 may be applied using the known steps of photolithography.

For optionally provided insulating layer 8 we explicitly refer to German Patent Application (Docket Number R. 40124 with respect to Application EM 2000/2347-R 40124).

Reactive layer 9 may be applied in the same manner. However, particularly suitable is settling from the gas phase, e.g. by vapor deposit or sputtering, precipitation from the liquid phase by chemical or electrochemical precipitation, or also the application using thick film technique by silk-screen printing and also the application by sintering.

Polymeric cover layer 10 may, for example, be applied by dipping, by spraying on, by spin-coating or by scraping on.

Polymeric cover layer 10 provided according to the present invention on the one hand protects reactive layer 9 from atmospheric corrosion and from corrosion by the pyrotechnical material, or rather a chemical reaction with it. In addition, at elevated temperature, it reacts with the material of reactive layer 9.

Thus, when there is current flowing through resistance layer 3, for example, by capacitor discharge of a capacitor in a control circuit, it is heated. Because of the heating of resistance layer 3, reactive layer 9 is also heated, possibly all the way through insulating layer 8. Now, if there is heating, reactive layer 9 reacts with polymeric cover layer 10, strongly exothermically, to be sure. The pyrotechnical material may thereby be initiated, i.e. the ignition of this pyrotechnical material may be initiated.

EXEMPLARY EMBODIMENT

When Zr is the material for reactive layer 9 and perfluorinated polymer is the material for polymeric cover layer 10, the result of the reaction $$Zr+\text{fluoropolymer} \rightarrow ZrF_4+C$$

is a reaction enthalpy of $\Delta H=-1058$ kJ/mol. The basis for this are the reactions $$Zr+2F_2 \rightarrow ZrF_4 \text{ with } \Delta H=-1913 \text{ kJ/mol},$$

$$7C+8F_2 \rightarrow C_7F_{16}(1) \text{ with } \Delta H=-3420 \text{ kJ/mol}$$

(wherein perfluoroheptane substitutes for fluoropolymer);

$$Zr(s)+0.25\ C_7F_{16}(1) \rightarrow 1.75\ C(s)+ZrF_4(s) \text{ with } \Delta H=-1913-(0.25\times-3420)=-1058 \text{ kJ/mol}$$

(numbers taken from "CRC Handbook of Chemistry and Physics", 72 ns Edition).

To be sure, when setting equal perfluoroheptane to a fluoropolymer, neither the heat of fusion of perfluoroheptane of ca 10 kJ/mol nor the chain length of the fluoropolymer are considered. However, it appears that the above estimate is sufficiently accurate.

A stoichiometric construction is recommended. In that case, the result of using the molar masses and densities is a layer thickness ratio of Zr (reactive layer 9) to perfluoropolymer (polymer cover layer 10) of approximately 1:3.

Thus the result is not only corrosion protection for reactive layer 9, but also ignition energy which is approximately one-third higher than for the usual combination described at the beginning.

For various other materials for reactive layer 9 and for perfluorinated polymer as the material for polymer cover layer 10, the results are the following reaction enthalpies $\Delta H$:

| Reactive Layer 9 | ΔH (Reaction Enthalpy) kJ/mol |
|---|---|
| Hf | $HfF_4$ − 1930 = −1075 |
| Al | $AlF_3$ − 1503 = −862 |
| Ta | $TaF_5$ − 1904 = −835 |
| Nb | $NbF_5$ − 1810 = −741 |
| Y | $YF_3$ − 1718 = −1076 |
| Ce | $CeF_3$ − 1722,69 = −1081,44 |
| Nd | $NdF_3$ − 1656,9 = −1015,65 |
| Si | $SiF_4$ − 1615 = −760 |

There now follows as an example the explanation of the preparation of a bridge-type igniter ignition element (also called reactive bridge-type igniter) as the ignition element especially for air bags, while taking as a basis thin-film technique on an integrated circuit (IC). As the basic element, an application-specific integrated circuit (ASIC) on a silicon substrate is especially suitable, since, as was mentioned at the beginning, control circuits and protective circuits are able to be applied on a common substrate.

As is usual in the photolithographic method, a negative photo-resist is first applied and is masked. There is then carried out an exposure to UV light (e.g. of 365 nm wavelength). The masked areas on the photo-resist not exposed to UV light remain standing upon etching with a developing solution, and the other areas are removed. There now takes place the application of an adhesive layer 4 made of titanium, for example, by sputtering on to a thickness of about 30 nm. Subsequently, for resistance layer 3, palladium is also sputtered on, namely to a thickness of 300 nm. If necessary, copper oxide CuO may then be applied as insulating layer 8 up to a thickness of 100 nm, for example, also by sputtering. Finally, reactive layer 9 is then applied, for example, Zr at a layer thickness of 1 $\mu$m, for example, also by sputtering or by another application method.

Subsequently, the photo-resist, so far left behind, is removed by a suitable solvent and then polymeric cover layer 10 is applied (as protective layer and reaction partner); as an example, protective lacquer FC722, a fluoropolymer, is applied by spin-on deposition to a thickness of 3 $\mu$m and is cured. The application of the polymer using other procedures, e.g. using a dispenser, is also possible. Thereby polymer cover layer 10 covers at least bridge section 5 or resistor element 11 of ignition element 1 on all sides, down to substrate 2.

Contact layer 7 at connecting sections 6 may be applied in a manner known per se to resistance layer 3 in the appropriate sections. Also, using procedures known per se, which are also known, for example, from the manufacture of hybrid circuits, thick-film circuits and thin-film circuits and integrated circuits, an electrically conductive connection from resistance layer 3 may be provided in the region of connecting sections 6 to a provided control circuit and/or a protective circuit (not shown) on the same substrate 2.

What is claimed is:

1. A bridge-type igniter ignition element for initiating an ignition of a pyrotechnical material lying above the ignition element, by heating when an electric current is passed through, comprising:

electrical connecting elements at an end;

a plurality of resistor elements disposed between the connecting elements, wherein each resistor element includes a resistance layer and an adhesive layer;

a substrate on which the connecting elements and the resistor elements are mounted;

a polymeric cover layer for providing protection from surroundings and the pyrotechnical material;

a reactive layer of the resistor elements covered by the polymeric cover layer, wherein the reactive layer is positioned on top of the resistance layer; and an insulating layer provided between the resistance layer and the reactive layer.

2. The ignition element as recited in claim 1, wherein: the reactive layer includes an oxidizable metal.

3. The ignition element as recited in claim 2, wherein:

the reactive layer is porous.

4. The ignition element as recited in claim 2, wherein:

the reactive layer includes at least one of Zr, Al, Hf, Ta, Nb, Y, Si, Ce, and all lanthanides.

5. The ignition element as recited in claim 1, wherein:

the polymeric cover layer is formed such that the polymeric cover layer reacts with a material of the reactive layer at an elevated temperature.

6. The ignition element as recited in claim 5, wherein:

a material of the polymeric cover layer includes at least one of a fluorine-containing polymer, a chlorine-containing polymer, and an oxygen-containing polymer.

* * * * *